US006364130B2

(12) United States Patent
Wright

(10) Patent No.: US 6,364,130 B2
(45) Date of Patent: Apr. 2, 2002

(54) DISH RACK

(75) Inventor: Sabrena Wright, Bellevue, WA (US)

(73) Assignee: Progressive International Corp., Kent, WA (US)

( * ) Notice: Subject to any disclaimer, the term of this patent is extended or adjusted under 35 U.S.C. 154(b) by 0 days.

(21) Appl. No.: 09/761,544

(22) Filed: Jan. 16, 2001

Related U.S. Application Data

(60) Provisional application No. 60/176,352, filed on Jan. 14, 2000.

(51) Int. Cl.[7] ..... A47F 5/00
(52) U.S. Cl. ..... 211/41.3; D7/55; 211/184
(58) Field of Search ..... 211/41.3, 41.4, 211/41.5, 184; D32/55, 56, 57

(56) References Cited

U.S. PATENT DOCUMENTS

D164,197 S * 8/1951 Planeta
3,669,278 A * 6/1972 Heroy
4,592,471 A * 6/1986 Bross ..... 211/184 X
D370,323 S * 5/1996 Lafond ..... D32/55
D374,526 S * 10/1996 Breen et al. ..... D32/55
D413,700 S * 9/1999 Wang ..... D32/55
6,170,676 B1 * 1/2001 Patadia et al. ..... 211/41.6
D439,716 S * 3/2001 Wright ..... D32/55

* cited by examiner

*Primary Examiner*—Robert W. Gibson, Jr.
(74) *Attorney, Agent, or Firm*—John R. Benefiel

(57) ABSTRACT

A dish rack has a main deck piece formed of sheet metal of stainless steel, with a perforated region allowing wire form glass holders to be variably positioned thereon, and a row of spaced apart bands adjacent one edge for holding the plates, saucers, and the like. Rolled side edges space the deck piece above a supporting surface.

12 Claims, 5 Drawing Sheets

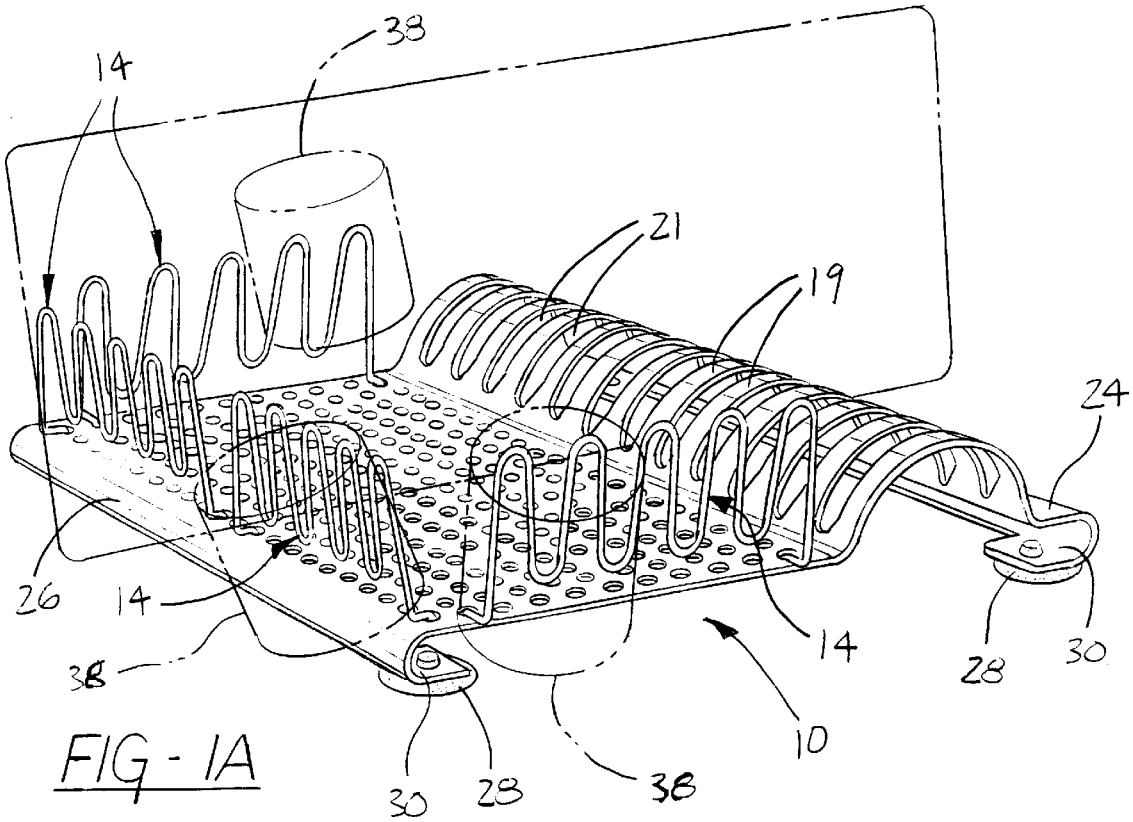
FIG - 1A
FIG - 8
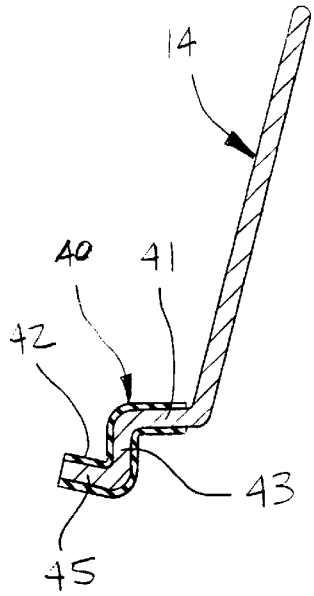

DISH RACK

CROSS REFERENCE TO RELATED APPLICATION

This application claims the benefit of U.S. provisional patent application Ser. No. 60/176,352, filed on Jan. 14, 2000.

BACKGROUND OF THE INVENTION

The invention concerns racks and more particularly racks especially adapted to hold dishes while draining and drying after washing the same.

Dish racks are generally utilitarian in appearance and have a fixed configuration such as to not be changeable to better suit the type and number of dishes to be accommodated.

It is desirable to have a more aesthically pleasing design, particularly since the racks are often left in view in the kitchen.

It is the object of the present invention to provide a dish rack which has a high degree of aesthetic appeal, is versatile in adapting to the type of dishware items to be accommodated, while being simple and low in cost to manufacture.

SUMMARY OF THE INVENTION

The above objects and others which will become apparent upon a reading of the following specification and claims are achieved by a rack including a rectangular metal sheet forming a deck piece, preferably of polished or satin stainless steel, which has one section which has aligned rows of perforations adapted to receive wire forms in serpentine shape to provide upright loops, with wire ends at each end able to be inserted in the perforations to support the wire forms in an upright position above the sheet metal deck piece.

The upright flattened loops in the wire forms provide spaced finger supports for holding cups, glasses, mugs or the like, or for cookware. The wire forms can be repositioned at any spacing, position, or orientation to accommodate a wide variety of sizes and types of dishware items.

Another section of the deck piece has an integrally formed row of bands extending upwardly and spaced apart by intervening slots punched into the metal. The bands define supports for flat items such as plates and saucers. The wire forms can be positioned aligned with the bands to provide additional support for large platters or cooking sheets, etc.

Two opposite sides of the sheet metal deck piece are rolled over, a bottom lip edge mounting rubber feet at each comer of the deck to support the rack above the surface on which it is rested.

The polished metallic finish of the deck provides a sophisticated appearance, particularly when combined with the polished chrome wire forms.

The rack can be manufactured at relatively low cost while having a high quality look.

DESCRIPTION OF THE DRAWINGS

FIG. 1A is a fragmentary perspective view showing repositioning of wire forms included in the dish rack shown in FIG. 1.

FIG. 8 is a sectional view taken along the lines 8—8 in FIG. 7.

DETAILED DESCRIPTION

Figure 1:
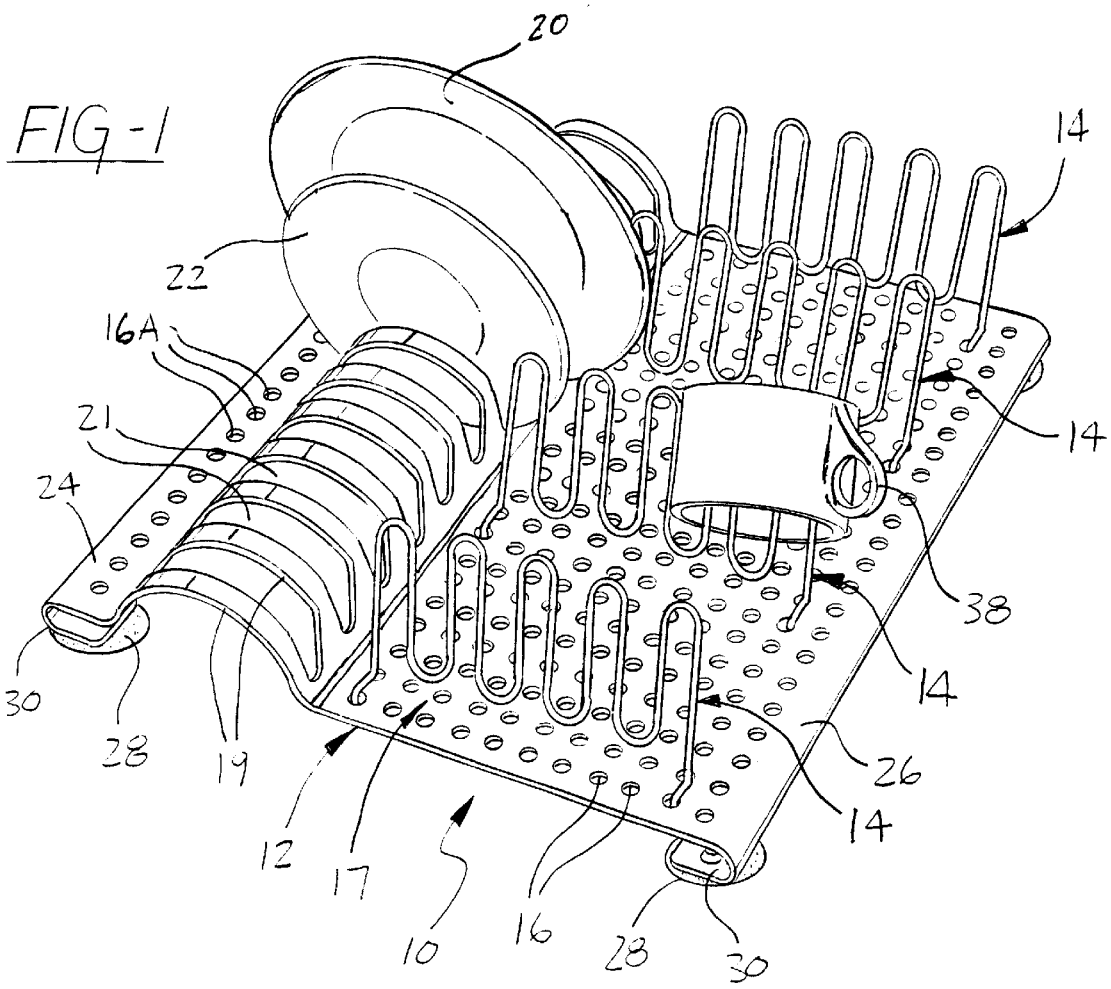
FIG. 1 is a perspective view of a dish rack according to the invention shown with a few dishes in place.
Figure 7:
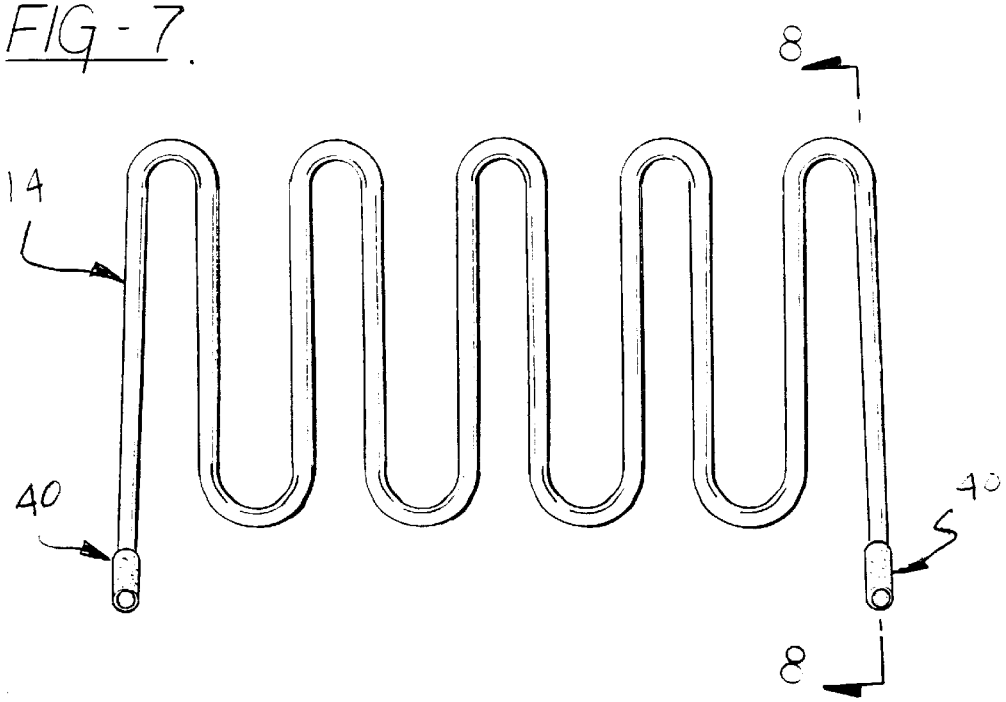
FIG. 7 is a front view of one of the wire forms used to support cups, glasses and cookware.
Figure 2:
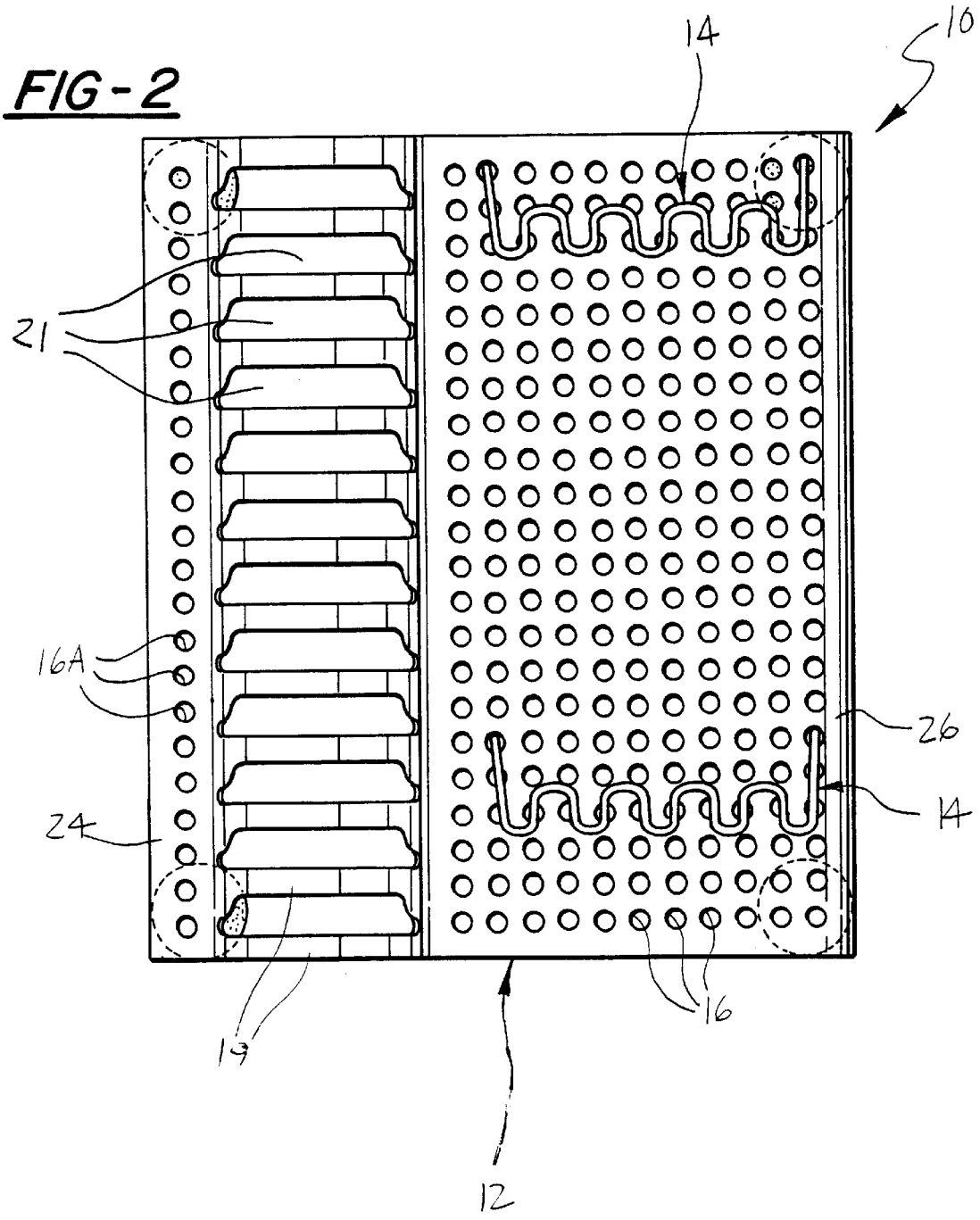
FIG. 2 is a plan view of the dish rack shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a dish rack 10 according to the invention includes a formed sheet metal deck piece 12 of a rectangular shape, a plurality of wire forms 14 which each have ends which are secured in respective perforations 16 in a main region 17 of the deck piece 12 adjacent one side edge 26. The perforations 16 are formed in orthogonal rows at spacings such as to allow the opposite foot ends of the wire forms 14 to be received therein.

The deck 12 is also integrally formed with a series of bands 19 extending in a row along side edge 24, the bands 19 curving up over the level of the perforated region 17 and defining intervening slots 21 adapted to receive plateware, such as dinner plates 20, saucers 22, etc.

The bands 19 extend to formed left side edge 24 which is similar to the opposite right side edge 26.

Four suction feet 28 can be mounted at each comer secured to lower edge 30 of each formed side edge 24, 26, to support the deck piece 12 spaced above a surface on which it is placed.

The sheet metal deck 12 is preferably made of stainless steel having a polished brushed or satin finish to provide an attractive appearance.

The wire forms 14 similarly may be made of chrome plated steel of a bright or stainless steel with a polished, brushed or satin finish, and together provide an attractive appearance.

Figure 3:
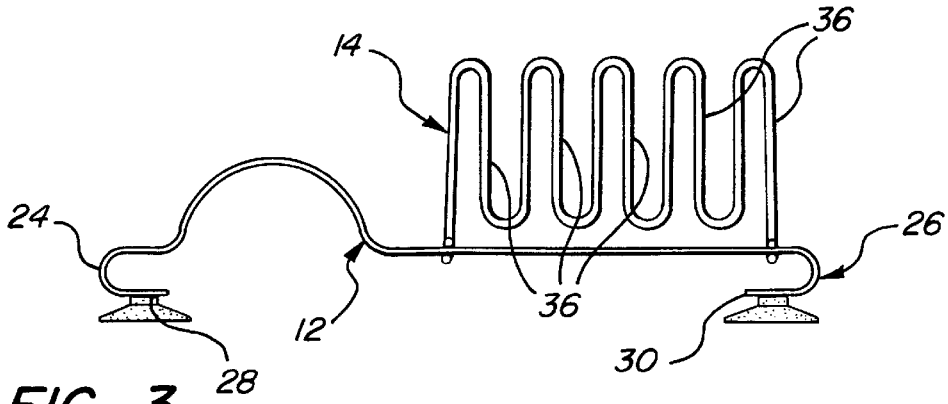
FIG. 3 is a front view of the dish rack shown in FIGS. 1 and 2 but without the suction cup feet.
Figure 6:
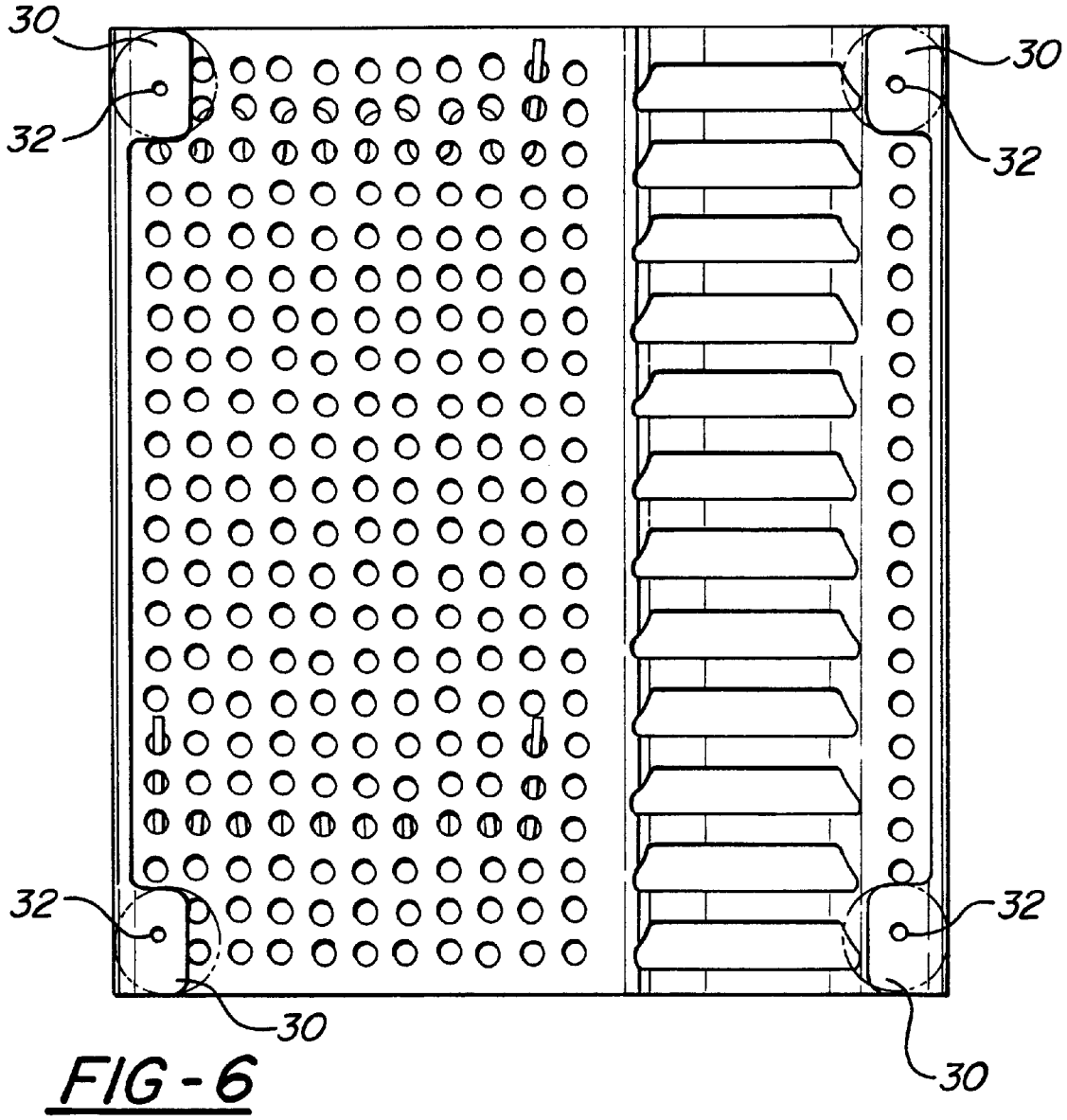
FIG. 6 is a bottom view of the dish rack shown in FIGS. 1–5.

FIG. 3 shows the formed edges 24, 26 in which the sheet metal is rolled over, with the edges 30 at each comer provided within punched openings (FIG. 6) suited to attach the suction cup feet 28.

Figure 4:
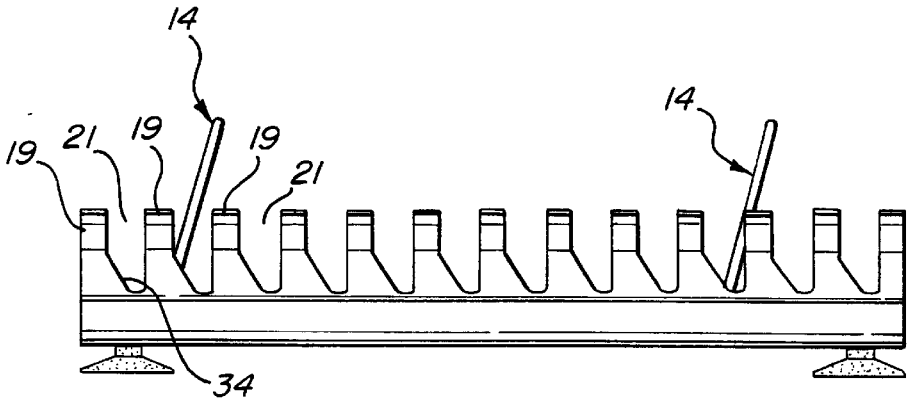
FIG. 4 is a left side view of the dish rack shown in FIGS. 1–3.
Figure 5:
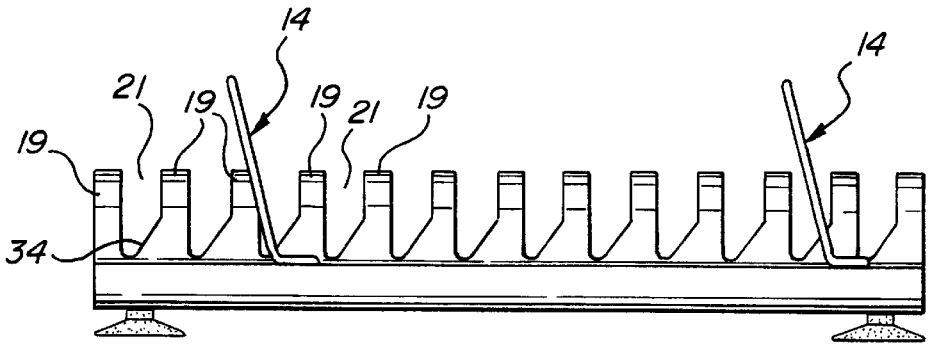
FIG. 5 is a right side view of the dish rack shown in FIGS. 1–4, but without the suction cup feet.

FIGS. 4 and 5 show that the slots 21 and bands 19 have sloping bottom edges 34 adapted to locate the rims of plates, saucers, etc. inserted in the slots 21 to assume the same inclination.

The wire forms 14 are serpentine in shape to form a series of parallel narrow flattened loops 36 (FIG. 3) defining upright fingers able to support cups 38, glasses, pots, etc.

The wire forms 14 have lower support wire ends 40 at each end which are spaced at a distance which matches the spacing between two of the perforations 16 so as to allow the ends 40 to be inserted into any two similarly spaced perforations to enable each of the wire forms 14 to be quickly mounted, removed or repositioned on the perforated portion of the metal deck 12 to accommodate the specific dishware items to be drained, as shown in FIGS. 1 and 1A.

The wire forms 14 can be repositioned normally to one edge as shown in FIG. 1A to save space. Also, the spaces between flattened loops 36 can be aligned with the slots 21 to provide extended support for large platters, pans, and the like as necessary. A row of perforations 16A are formed in the rolled edge 24 adjacent the bands 19 to provide another wire form maintaining location.

The lower wire form ends 40 are preferably coated with a vinyl coating or tubing 42 to secure the ends in the respective perforations 16 or 16A. The ends 40 include a generally horizontal segment 41, a vertical offset 43, and a slightly upturned tips 45. The wire formed 14 can be first turned sideways to insert the tips 45 into perforations 16 or 16A then turned up to allow advancing the segments 43 into the perforations 16, 16A. The wire forms 14 are slightly inclined from the vertical to insure that the tips 45 engage the undersurface of the deck piece 12.

The construction of the deck piece 12 as a formed metal sheet provides for an attractive functional support at low cost, since the bands, slots perforations, and rolled edges, are all integrally formed. The metal can be of thin gauge (1.5 mm thick) but still provide sufficient stiffness to easily support the weight of the dishes above a supporting surface on the rolled under side edge 24, 26.

The perforations 16, 16A should be substantially larger than the diameter of the wire form 14 to allow inserting and removal of the wire form ends to be easily done.

The metal used for the deck piece should be corrosion resistant and attractive in appearance. Steel is suitably strong and is preferred, but aluminum could also be used.

Stainless steel is attractive in appearance and will remain so through long periods of use without any surface coating to wear or chip.

However, primed and enameled steel may also be used.

Likewise, polished or brushed stainless steel may be used for the wire forms 14 instead of chrome plated steel wire (4 mm thick), although chrome plated steel is harder and more resistant to scratching, hence is preferred.

What is claimed is:

1. A dish rack comprising:

a generally rectangular and planar sheet metal deck piece having a perforated region with a patterned array of closely spaced perforations therein extending in orthogonal rows;

said deck piece also having a row of integrally formed upwardly extending bands spaced apart by intervening slots adjacent said perforated region, said bands defining plate holding supports;

one or more wire forms each having a series of spaced apart upright loops, having ends on either side extending down, sized and spaced to be fit into perforations spaced along either orthogonal direction in said perforated region, to be held with said loops extending upwardly to support glasses and the like.

2. The dish rack according to claim 1 wherein said deck piece has opposite side edges rolled under to hold said deck piece spaced above a supporting surface.

3. The dish rack according to claim 2 wherein said series of bands extend along one of said side edges, said perforated region adjacent the other side edge.

4. The dish rack according to claim 1 wherein said deck piece is formed of stainless steel.

5. The dish rack according to claim 4 wherein said one or more wire forms are constructed of chrome plated steel.

6. The dish rack according to claim 4 wherein said deck piece is constructed of polished stainless steel.

7. The dish rack according to claim 1 wherein said deck piece is punched out intermediate said bands to form said slots.

8. The dish rack according to claim 1 wherein a single row of perforations extends along in between said one side edge adjacent said row of bands.

9. The dish rack according to claim 1 wherein said one or more wire forms loops are flattened.

10. The dish rack according to claim 7 wherein said slots each have sloping bottom edges defined by adjacent bands.

11. The dish rack according to claim 2 further including suction feet mounted to an inturned edge of each of said side edges at each corner of said deck piece.

12. The dish rack according to claim 1 wherein said one or more wire forms are held slight inclined from the vertical above said perforated region.

* * * * *